US008698677B2

(12) United States Patent
Bungo et al.

(10) Patent No.: US 8,698,677 B2
(45) Date of Patent: Apr. 15, 2014

(54) MOBILE WIRELESS TERMINAL AND ANTENNA DEVICE

(75) Inventors: Akihiro Bungo, Tokyo (JP); Toshiya Kusama, Kanagawa (JP)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 422 days.

(21) Appl. No.: 13/069,956

(22) Filed: Mar. 23, 2011

(65) Prior Publication Data

US 2011/0248895 A1 Oct. 13, 2011

Related U.S. Application Data

(60) Provisional application No. 61/322,494, filed on Apr. 9, 2010.

(51) Int. Cl.
*H01Q 1/24* (2006.01)

(52) U.S. Cl.
USPC ..... 343/702; 343/833; 343/834; 343/893

(58) Field of Classification Search
USPC ..... 343/702, 833–834, 893
See application file for complete search history.

(56) References Cited

U.S. PATENT DOCUMENTS 7,202,821 B2 * 4/2007 Fujikawa et al. ..... 343/700 MS

FOREIGN PATENT DOCUMENTS

JP 2009-225068 A 10/2009

OTHER PUBLICATIONS

U.S. Appl. No. 13/358,059, filed Jan. 25, 2012, Bungo.

* cited by examiner

*Primary Examiner* — Kristy A Haupt
(74) *Attorney, Agent, or Firm* — Oblon, Spivak, McClelland, Maier & Neustadt, L.L.P.

(57) ABSTRACT

A mobile wireless terminal includes a housing, a cover removably attached to the housing, and an antenna device disposed inside the housing. The antenna device includes a first antenna element that is disposed inside the housing and serves as a feed element, a plate that provides a ground plane for the first antenna element, and a second antenna element that is formed on one surface of the cover so as to face the first antenna element with the cover being attached to the housing and capacitively couple to the first antenna element and that serves as a parasitic element.

16 Claims, 17 Drawing Sheets

MOBILE WIRELESS TERMINAL AND ANTENNA DEVICE

CROSS REFERENCE TO RELATED APPLICATION

The present application claims the benefit of the earlier filing date of U.S. Provisional Patent Application Ser. No. 61/322,494 filed Apr. 9, 2010, the entire contents of which being incorporated herein by reference.

BACKGROUND

1. Technical Field

The present invention relates to mobile wireless terminals, such as mobile phone terminals, and antenna devices thereof.

2. Description of the Related Art

Recently, the performance and the number of functions of mobile wireless terminals, such as mobile phone terminals, have been increased. Mobile wireless terminals are emerging that make wireless communication functions, such as functions of telephone communication, data communication, the global positioning system (GPS), a wireless local area network (LAN), and BLUETOOTH available.

One type of antenna for use in such wireless communication is a λ/4 monopole antenna including a plate and an antenna element having a length of a quarter of wavelength of a frequency to be used.

Japanese Unexamined Patent Application Publication No. 2009-225068 discloses a monopole antenna that produces circular or elliptically polarization with a combination of a feed element, a parasitic element, and a ground plate (i.e., a plate). More specifically, the feed element and the parasitic element are bent in an inverted L shape against the ground plate. The bent sides of the feed element and the parasitic element are disposed in different directions to form a truncated chevron with an angle θ. Transmission power is fed from a point between the feed element and the ground plate, whereas reception power is extracted at the point. The parasitic element is electrically connected to the ground plate. The length of the parasitic element is set to be equal to or smaller than that of the feed element.

SUMMARY

Intentionally controlling a directivity of typical λ/4 monopole antennas, such as the above-described one, is difficult because the size of a plate greatly affects the directivity. GPS antennas, particularly, are often disposed at a top part of terminals in consideration for an effect of hands (hand effect) of users holding housings of the terminals. However, the directivity of the GPS antennas often points to the surface of the Earth.

Preferable characteristics of GPS antennas mounted in mobile phone terminals are the following:

(1) Directivity of the GPS antennas points to the sky. That is, antenna efficiency in an upper hemisphere is high.

(2) Directivity of the GPS antennas is free from nulls (where antenna efficiency greatly drops), particularly, in the upper hemisphere because it is difficult to catch signals from satellites located in directions of the nulls. For example, positioning is unsuccessfully performed in an environment having a narrow airspace.

Japanese Unexamined Patent Application Publication No. 2009-225068 does not mention nulls and how to control the directivity of the antenna to point to the sky. Additionally, disposing the feed element and the parasitic element in different directions inside a housing of a terminal to form a truncated chevron with an angle θ against the plate disadvantageously takes up a wide space.

In view of such a background, in accordance with an embodiment of the present invention, an antenna device is provided that has a relatively simple structure and takes up a relatively narrow space but is capable of exhibiting excellent antenna directivity toward the sky. In accordance with another embodiment of the present invention, a mobile wireless terminal including such an antenna device is provided.

A mobile wireless terminal according to an embodiment of the present invention includes a housing, a cover removably attached to the housing, and an antenna device disposed inside the housing. The antenna device includes a first antenna element that is disposed inside the housing and serves as a feed element, a plate that provides a ground plane for the first antenna element, and a second antenna element that is formed on one surface of the cover to face the first antenna element with the cover being attached to the housing and capacitively couple to the first antenna element and that serves as a parasitic element.

According to an embodiment, the first antenna element may have a length of approximately a quarter of wavelength of a target radio signal frequency of the antenna device, whereas the second antenna element may be longer than the first antenna element. More specifically, the second antenna element may have a length of approximately three eighths of the wavelength of the target radio signal frequency.

The antenna device of the mobile wireless terminal may further include a third antenna element that capacitively couples to the first antenna element.

A mobile wireless terminal according to another embodiment of the present invention includes a housing, and an antenna device disposed inside the housing. The antenna device includes a first antenna element that is disposed inside the housing, includes a comb-teeth-like portion at one side, and serves as a feed element, a plate that provides a ground plane for the first antenna element, and a second antenna element. The second antenna element includes a comb-teeth-like portion facing the comb-teeth-like portion of the first antenna element to engage with each other in virtually the same plane and capacitively couples to the first antenna element.

An antenna device according to an embodiment of the present invention is to be mounted in a mobile wireless terminal and includes a first antenna element that is disposed inside a housing of the mobile wireless terminal and serves as a feed element, a plate that provides a ground plane for the first antenna element, and a second antenna element that is formed on one surface of a cover removably attached to the housing so as to face the first antenna element with the cover being attached to the housing and capacitively couple to the first antenna element and that serves as a parasitic element.

An antenna device according to another embodiment of the present invention includes a first antenna element that includes a comb-teeth-like portion at one side and serves as a feed element, a plate that provides a ground plane for the first antenna element, and a second antenna element that includes a comb-teeth-like portion facing the comb-teeth-like portion of the first antenna element to engage with each other on virtually the same plane and that capacitively couples to the first antenna element.

Other configurations and advantages of the present invention are as shown in a detailed description of the present invention given below.

Antenna devices according to embodiments of the present invention and mobile wireless terminals including the antenna elements can eliminate nulls in an antenna characteristic pattern toward the sky with a relatively simple structure and a relatively narrow space to exhibit excellent antenna directivity. These antenna devices are particularly suitable for GPS antennas.

BRIEF DESCRIPTION OF THE DRAWINGS

FIG. 11A is a diagram illustrating an example of a configuration of a first modification of the antenna device illustrated in FIG. 4, whereas

FIG. 16A is a diagram illustrating a result of composing radiation patterns of excitation modes 1 and 2 of a monopole antenna according to the related art, whereas

DESCRIPTION OF THE EMBODIMENTS

Mobile wireless terminals according to embodiments of the present invention will be described in detail below with reference to the accompanying drawings. In the embodiments, the description is mainly given for a mobile phone terminal having a GPS antenna, for example.

Figure 1:
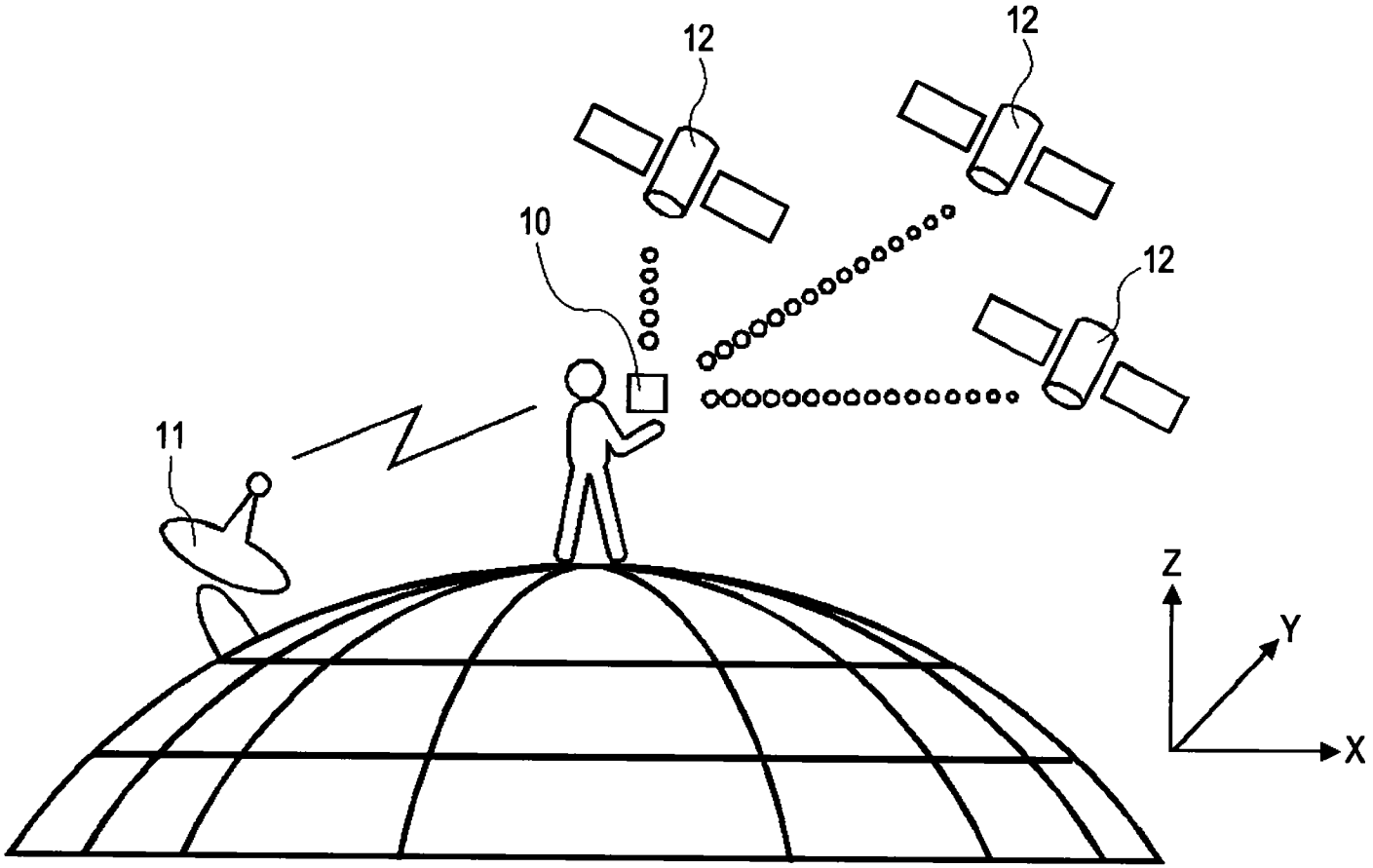
FIG. 1 is a diagram illustrating a state of a mobile wireless terminal being used by a user.

FIG. 1 illustrates a state of a mobile wireless terminal 10 being used by a user. The mobile wireless terminal 10 transmits and receives radio signals (radio waves) to and from a base station 11 located on the ground, respectively. The mobile wireless terminal 10 also receives radio signals (radio waves) from a plurality of GPS satellites 12 located in the space.

Figure 2:
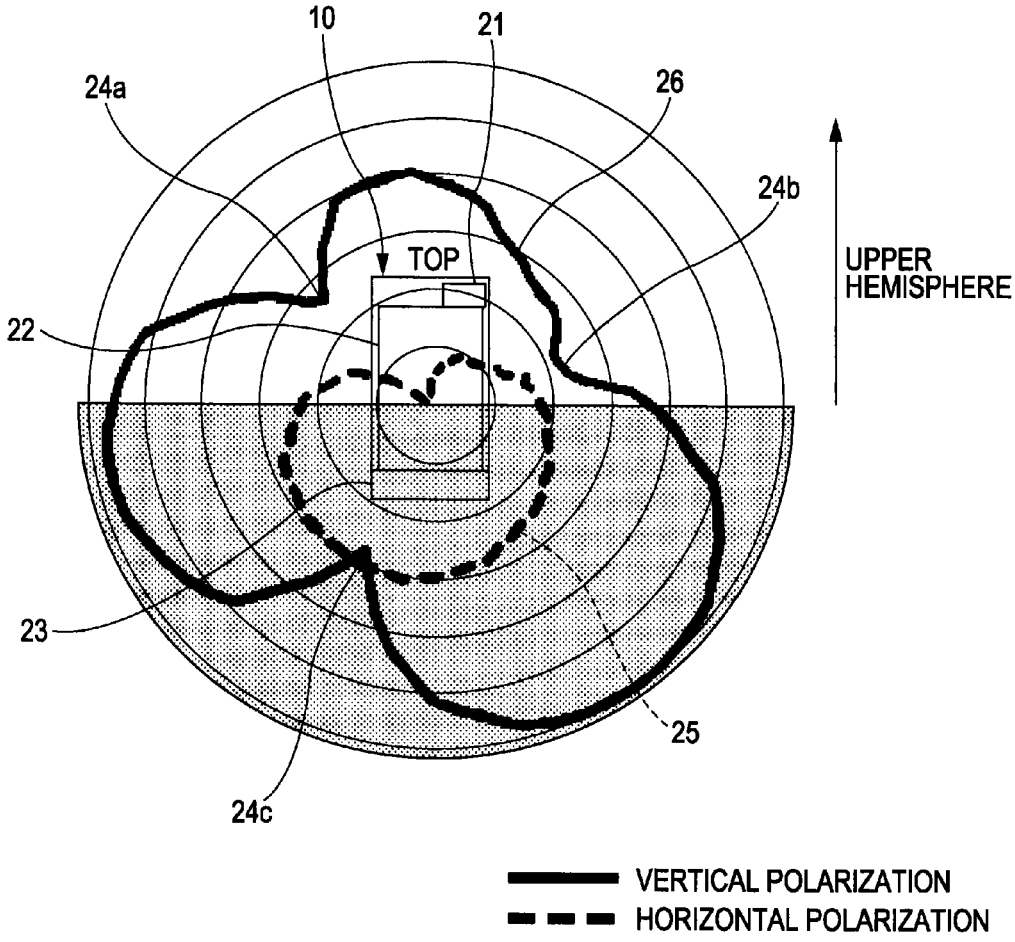
FIG. 2 is a diagram illustrating a mobile wireless terminal held by a user standing on the ground and an antenna characteristic pattern thereof.

FIG. 2 illustrates the mobile wireless terminal 10 held by a user standing on the ground and an antenna characteristic pattern thereof. In this example, the mobile wireless terminal 10 includes a liquid crystal display (LCD) 22 serving as a display unit and an antenna device 21 serving as a GPS antenna. The antenna device 21 is disposed above the LCD 22, i.e., at a top part of the mobile wireless terminal 10. The mobile wireless terminal 10 further includes an antenna device 23 serving as a mobile phone cellular antenna under the LCD 22. The illustrated characteristic pattern is a two-dimensional radiation pattern of the antenna device 21 in a Z-Y plane. In FIG. 2, a solid curve 26 represents a radiation pattern of vertical polarization of the antenna device 21, whereas a dotted curve 25 represents a radiation pattern of horizontal polarization of the antenna device 21. Inwardly indented parts of the curve 26 represent nulls 24*a*, 24*b*, and 24*c* where antenna efficiency greatly drops. The nulls 24*a* and 24*b* on an upper hemisphere side, particularly, may cause inconvenience regarding antenna directivity for the GPS satellites 12. Herein, the "upper hemisphere" indicates a hemispherical space with respect to a user holding a mobile phone terminal on the ground.

Figure 3:
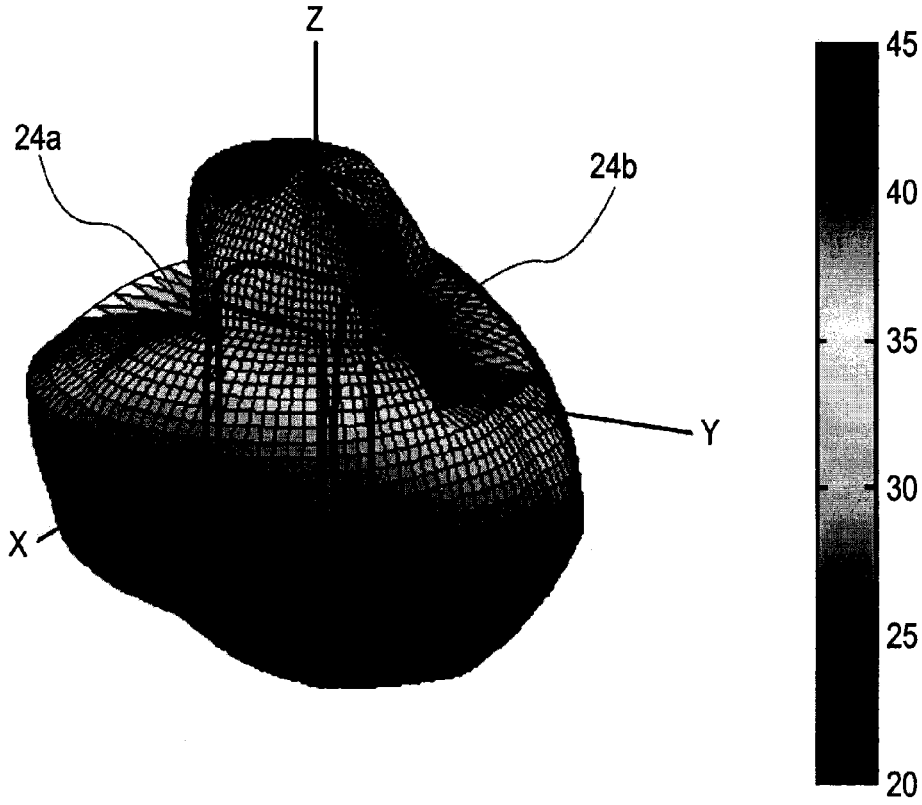
FIG. 3 is a diagram corresponding to the example of FIG. 2 and illustrating a three-dimensional antenna characteristic pattern (radiation pattern) of an antenna device.

FIG. 3 corresponds to the example of FIG. 2 and illustrates a three-dimensional antenna characteristic pattern (radiation pattern) of the antenna device 21. The nulls 24*a* and 24*b* are also observed in FIG. 3.

Figure 4:
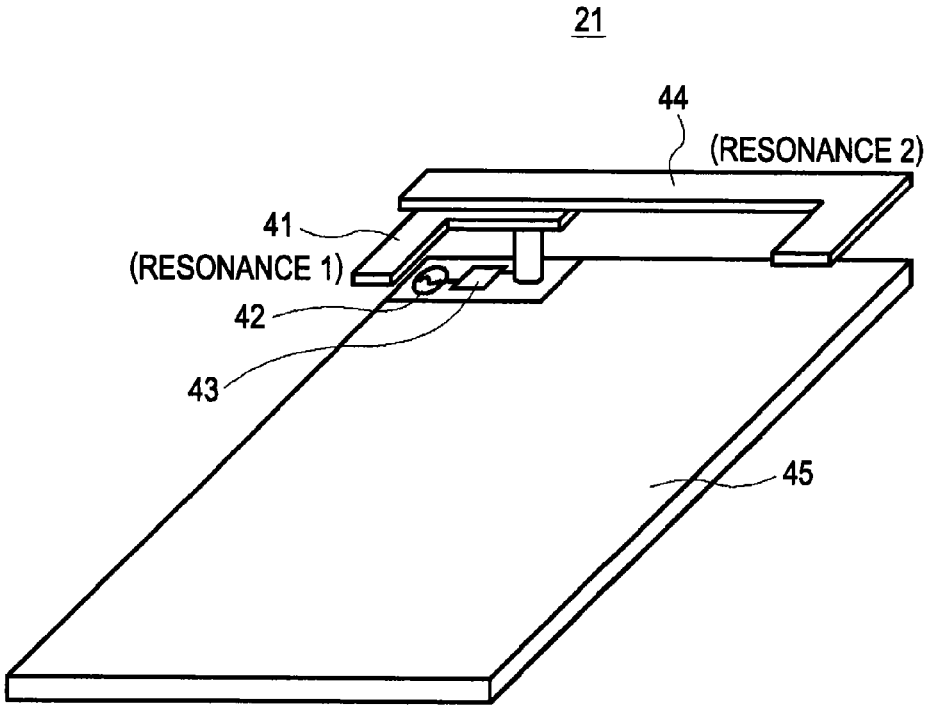
FIG. 4 is a diagram schematically illustrating an example of a configuration of an antenna device to be included in a mobile wireless terminal according to an embodiment of the present invention.

FIG. 4 schematically illustrates an example of a configuration of the antenna device 21 to be included in the mobile wireless terminal 10 according to an embodiment.

The antenna device 21 includes a first antenna element 41 serving as a feed element disposed inside a housing (not illustrated) and a plate 45 providing a ground plane for the first antenna element 41. The antenna device 21 further includes a second antenna element 44 serving as a parasitic element. The first and second antenna elements 41 and 44 are long and narrow plates or foils composed of conductive materials, such as metal. In practice, each of the first and second antenna elements 41 and 44 is formed or adhered on an insulating material (not illustrated). The first antenna element 41 is connected to a feed point 42 through a matching circuit 43. The feed point 42 connects the antenna device 21 to a feeder for supplying high-frequency electric power to the first antenna element 41. In a reception antenna, voltage or current is extracted from electromagnetic energy received by the first antenna element 41 at the feed point.

The antenna device 21 constitutes a monopole antenna. A length of the first antenna element 41 along a longitudinal direction is approximately a quarter of wavelength ($\lambda/4$) of a target radio signal frequency of the antenna device 21. In a GPS antenna, this length is approximately 40 mm. A length (along the longitudinal direction) of the second antenna element 44 is larger than that of the first antenna element 41. In this example, the second antenna element 44 has a length of approximately three eighths of the wavelength ($3\lambda/8$) of the target radio signal frequency. In a GPS antenna, this length is approximately 60 mm. Although the first and second antenna elements 41 and 44 are bent in an L shape in consideration for a size of the housing, the first and second antenna elements 41 and 44 do not have to be bent.

At least a part of the second antenna element 44 faces (opposes) at least a part of the first antenna element 41 substantially in parallel to suitably form capacitive coupling. The second antenna element 44 is insulated from the plate 45 and the first antenna element 41. According to an embodiment, the second antenna element 44 is formed on one surface (e.g., an inner surface) of a cover of the housing. When the cover is attached to the housing, the first and second antenna elements 41 and 44 being coupled to one another via capacitive coupling.

Figure 5:
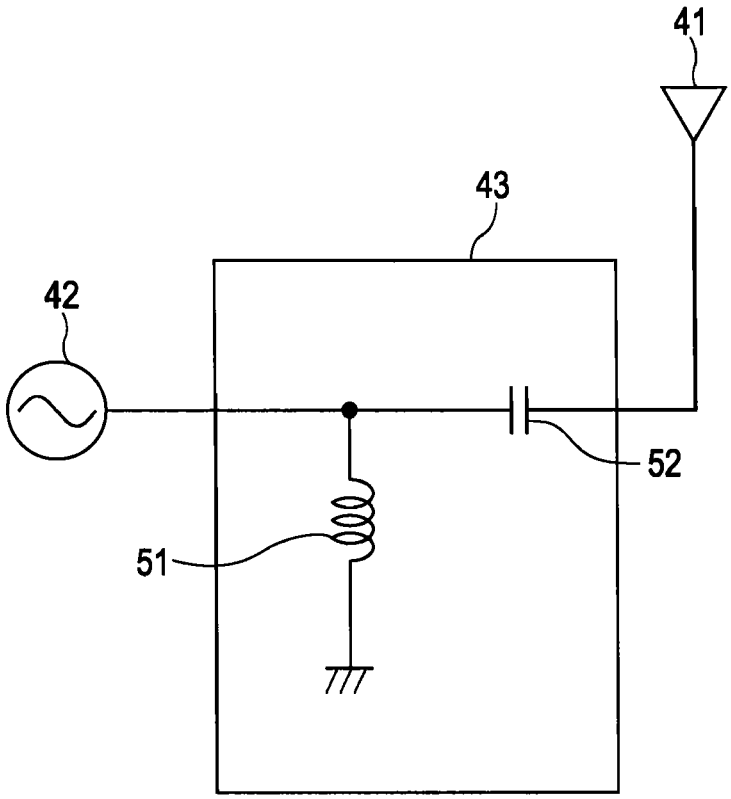
FIG. 5 is a diagram illustrating an equivalent circuit of an antenna device according to an embodiment of the present invention.

FIG. 5 illustrates an equivalent circuit of the antenna device 21. The feed point 42 is connected to the first antenna element 41 through the matching circuit 43. The matching circuit 43 performs impedance matching between the antenna device 21 and a circuit connected to the antenna device 21. In this example, the matching circuit 43 includes a capacitor 52 connected to the first antenna element 41 in series and an inductor 51 connected to the first antenna element 41 in parallel.

Figure 6:
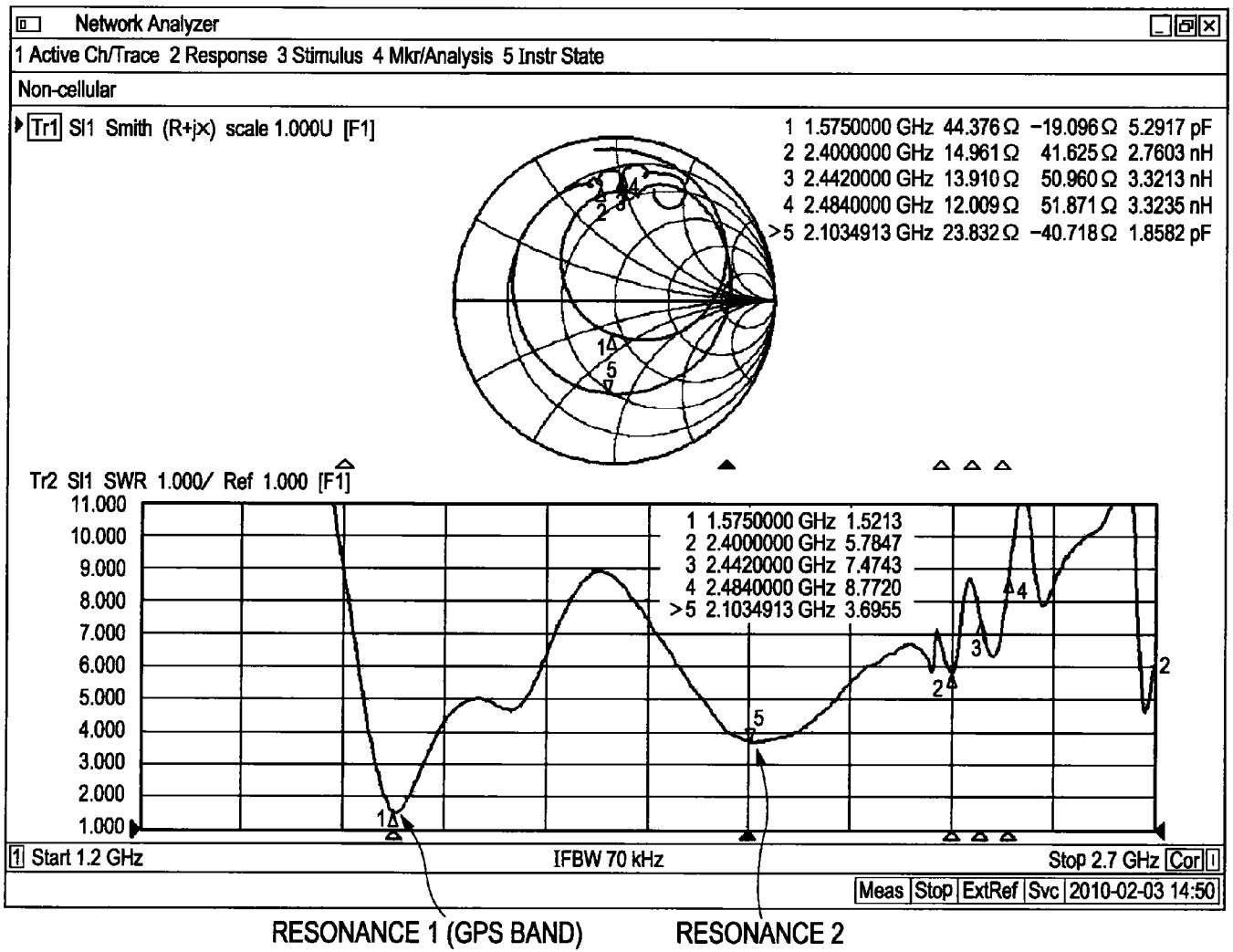
FIG. 6 is a diagram illustrating an actually measured frequency characteristic of the antenna device illustrated in FIG. 4.

FIG. 6 illustrates an actually measured frequency characteristic of the antenna device 21 illustrated in FIG. 4. As described above, the lengths of the first and second antenna elements 41 and 44 are set to approximately $\lambda/4$ and $3\lambda/8$, respectively. The size of the plate 45 used in this measurement is 50 mm×105 mm. FIG. 6 illustrates a change in a voltage standing wave ratio (VSWR) of the antenna device 21 in a frequency range of 1.2-2.7 GHz as a graph. FIG. 6 shows that first and second resonance frequency bands of the target radio signal frequency are generated. More specifically, this example shows the first resonance point at around 1.575 GHz in a GPS band and the second resonance point at around 2.1 GHz.

Figure 7:
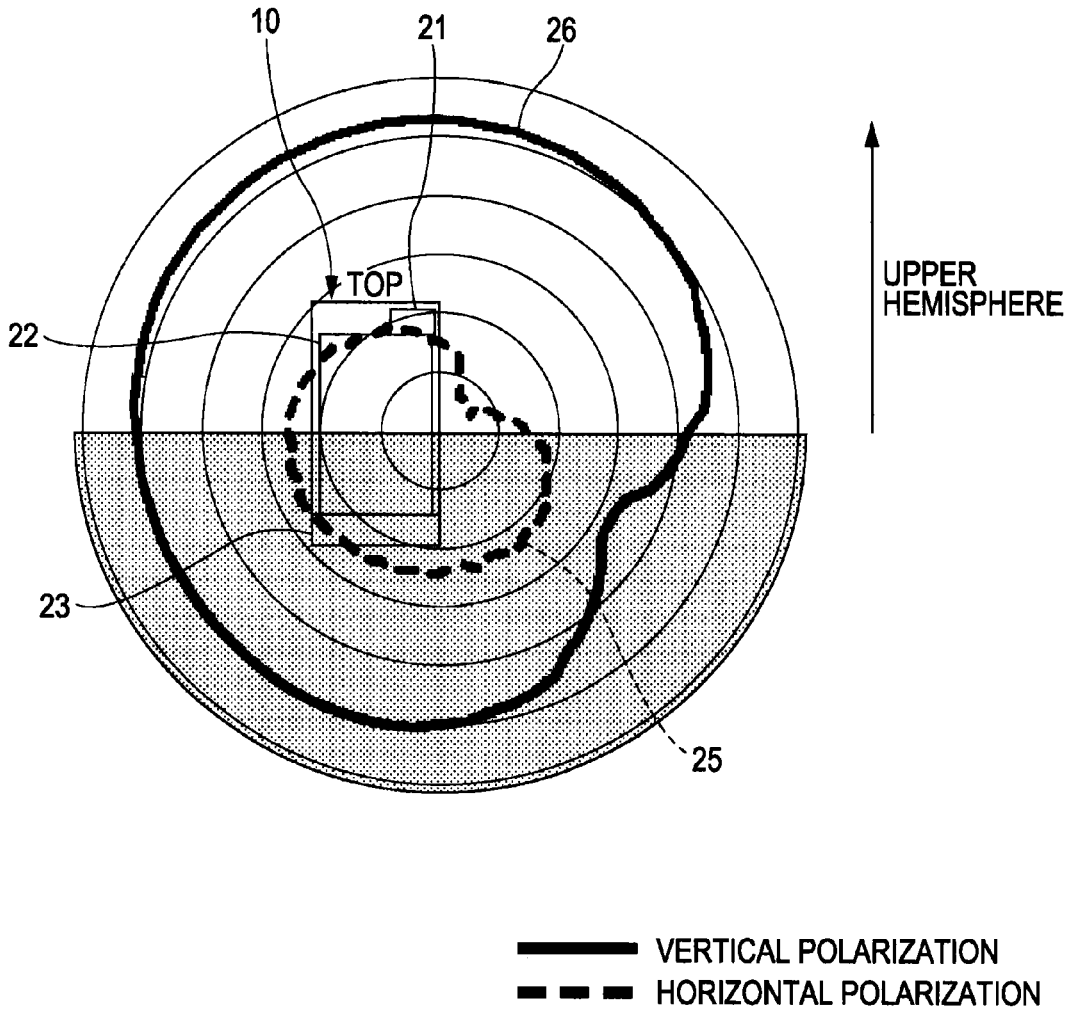
FIG. 7, like FIG. 2, is a diagram illustrating an antenna characteristic pattern of the antenna device illustrated in FIG. 4.

FIG. 7, like FIG. 2, illustrates an antenna characteristic pattern of the antenna device 21 illustrated in FIG. 4. Like reference characters are attached to the same or similar components as those illustrated in FIG. 2 to avoid repeated descriptions. FIG. 7 indicates that nulls (e.g., more than 1 dB for example, although deeper nulls of 2 or 3 dB as well) are eliminated in the upper hemisphere and directivity toward the sky is improved.

Figure 8:
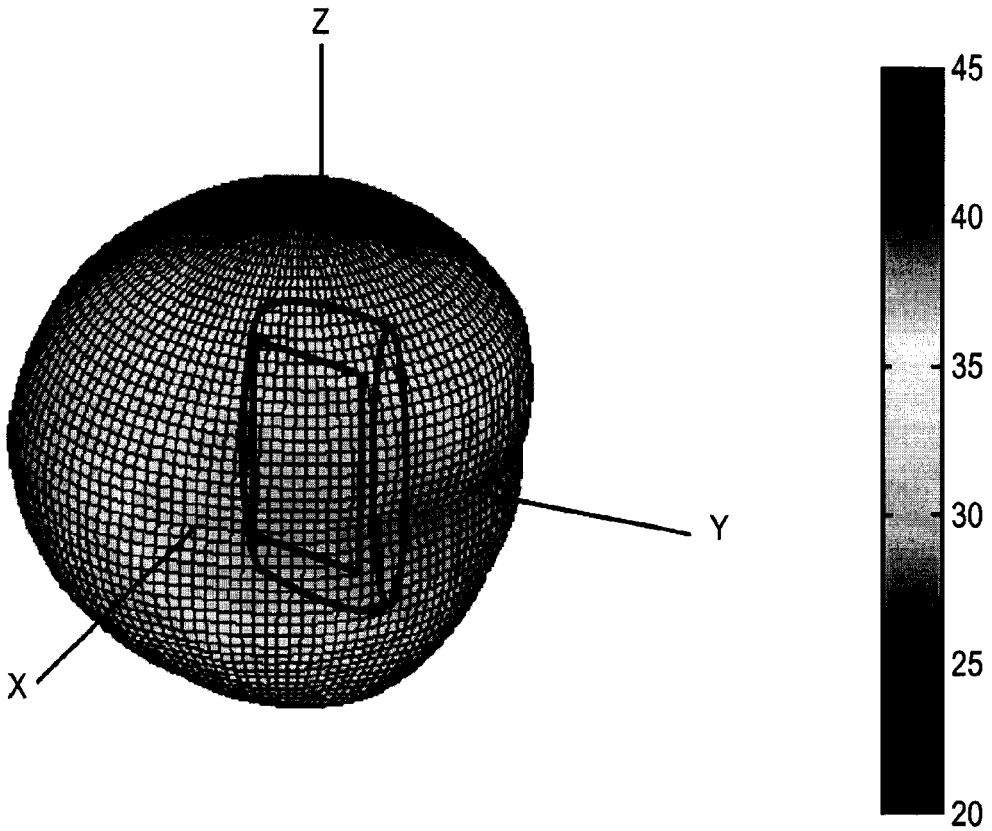
FIG. 8 is a diagram corresponding to the example of FIG. 7 and illustrating a three-dimensional antenna characteristic pattern (radiation pattern) of the antenna device.

FIG. 8 corresponds to the example of FIG. 7 and illustrates a three-dimensional antenna characteristic pattern (radiation pattern) of the antenna device 21. FIG. 8 also indicates that nulls are eliminated in the upper hemisphere and the antenna device 21 has excellent directivity as a GPS antenna.

Figure 9:
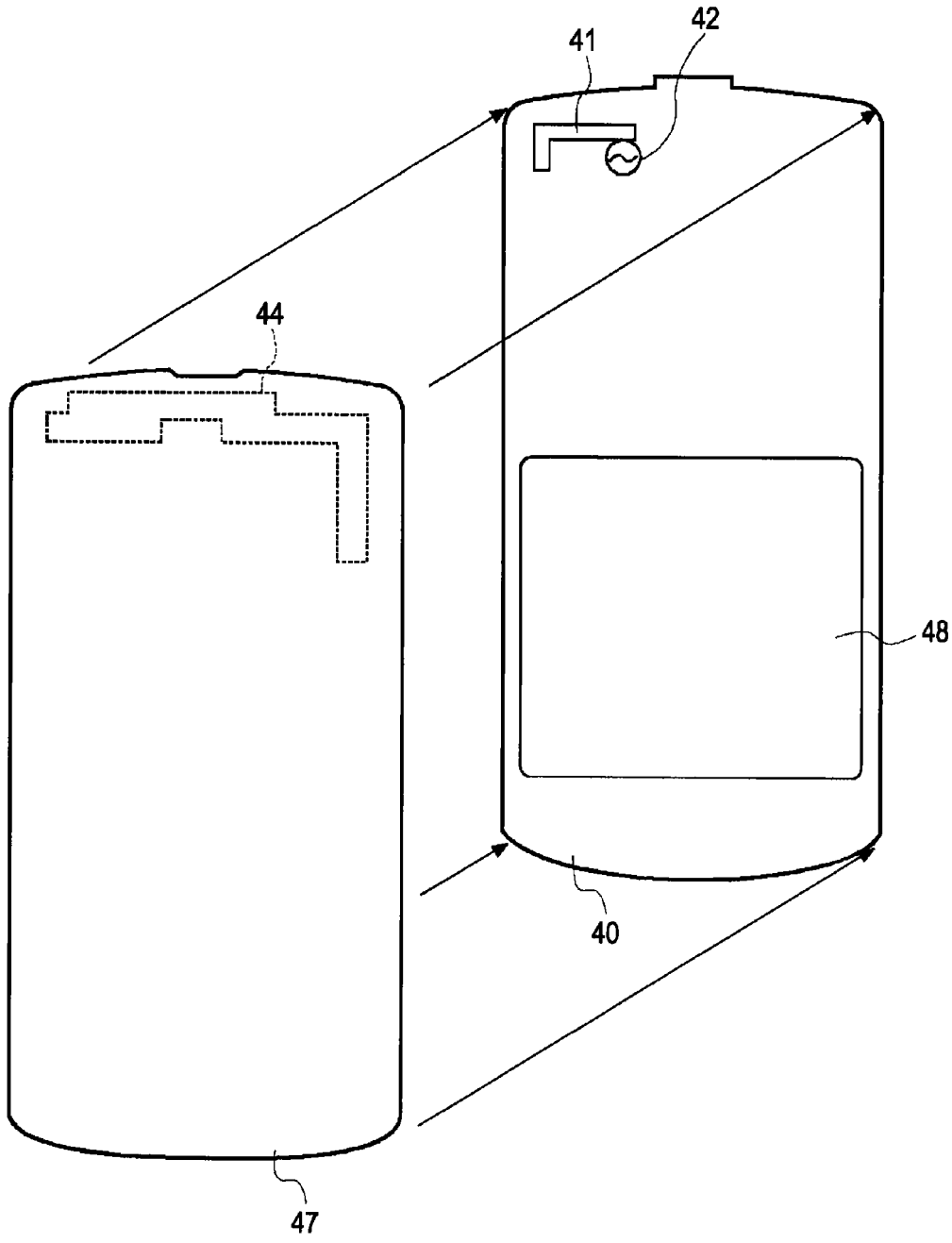
FIG. 9 is a diagram illustrating an application example of the antenna device illustrated in FIG. 4 to a mobile wireless terminal.

FIG. 9 illustrates an application example of the antenna device 21 illustrated in FIG. 4 to the mobile wireless terminal 10. The mobile wireless terminal 10 includes a cover 47 functioning as a battery cover and a housing 40 receiving the removable cover 47. FIG. 9 illustrates a state in which the cover 47 is removed from the housing 40. A battery 48 is stored in battery storage (i.e., a concave portion) of the housing 40. The first antenna element 41 and the feed point 42 are disposed at a top part of the mobile wireless terminal 10. The first antenna element 41, the matching circuit 43 (not illustrated in FIG. 9), and the feed point 42 are disposed inside the housing 40 of the mobile wireless terminal 10 as a monopole antenna unit. When the cover 47 is removed, the first antenna element 41 is exposed to outside.

The second antenna element 44 is formed on an inner surface (back surface) of the cover 47 by adhesion. When the cover 47 is attached to the housing 40, a surface of the second antenna element 44 partially faces a surface of the first antenna element 41 at a predetermined gap without contact to form expected capacitive coupling.

The surface of the cover 47 having the disposed second antenna element 44 does not have to be the inner surface. The second antenna element 44 may be disposed on an outer surface (front surface) of the cover 47 as long as the expected capacitive coupling is obtained with external appearance being maintained. As illustrated in FIG. 9, the second antenna element 44 may be irregularly bent in consideration for existence of other components in the housing 40.

Although a new component, namely, the second antenna element 44, is added as described above, a space for this new component is readily acquired in the mobile wireless terminal 10 by disposing the component on a surface of the cover 47. Additionally, because the second antenna element 44, i.e., a parasitic element, is free from electrical connection, the second antenna element 44 is suitable to be disposed on the removable cover 47.

Figure 10:
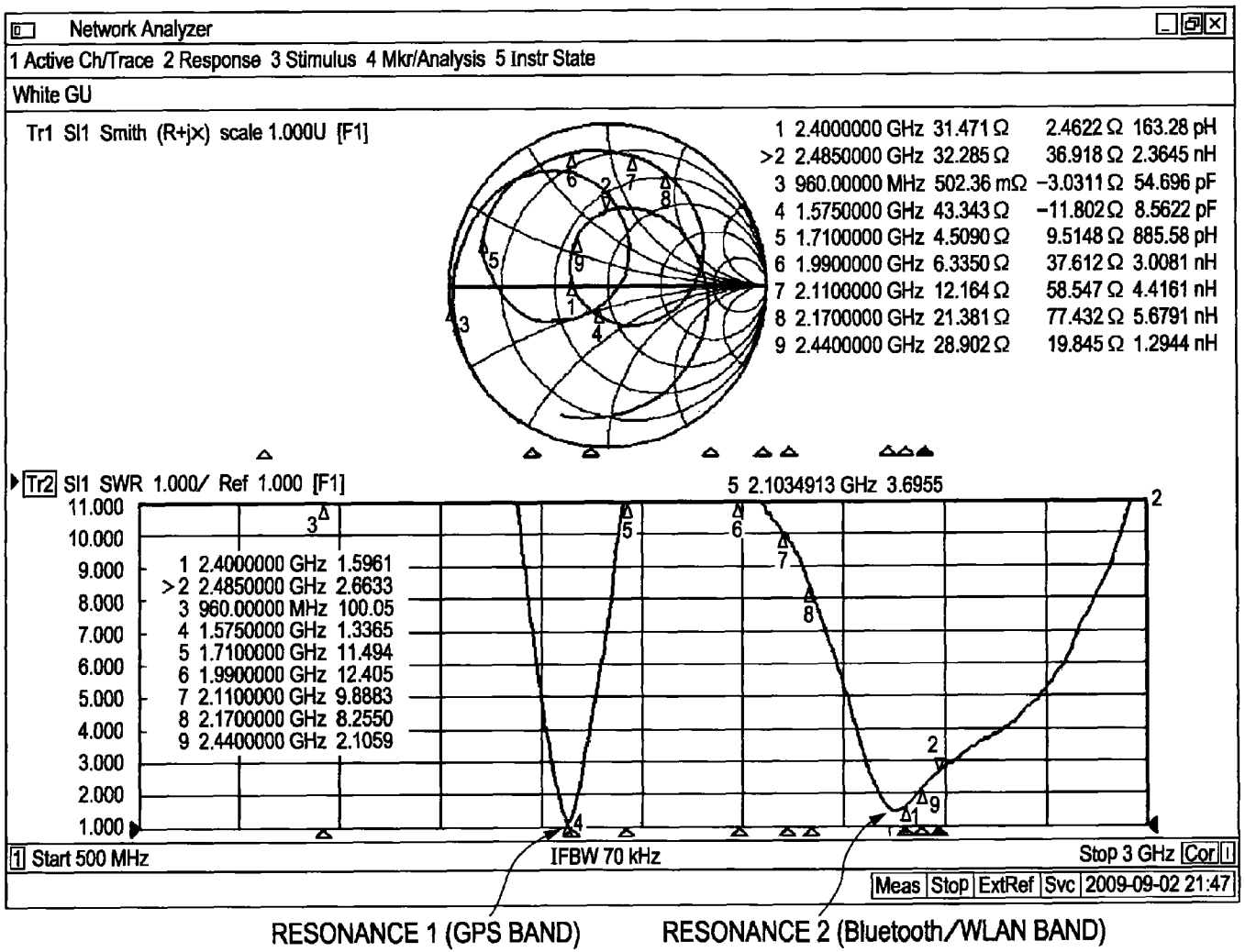
FIG. 10 is a diagram illustrating a frequency characteristic for describing another application example in which a second resonance point illustrated in FIG. 6 is utilized after adjustment.

FIG. 10 illustrates a diagram of a frequency characteristic for describing another application example in which the second resonance point illustrated in FIG. 6 is utilized after adjustment.

Factors for adjusting frequencies of two resonance points include the following:

(1) The matching circuit 43 (an inductor and a capacitor (2) A length of a monopole antenna element, i.e., the length of the first antenna element 41 serving as a feed element (3) A length of a parasitic element, i.e., the length of the second antenna element 44

(4) an overlapping amount (and a gap) of the first and second antenna elements 41 and 44, respectively.

Optimization of such factors allows the first resonance point (resonance 1) and the second resonance point (resonance 2) to be tuned to a band for GPS and a band for Bluetooth and a wireless local area network (WLAN), respectively, for example.

With such a configuration, an antenna having an ideal radiation pattern, i.e., an antenna having upward directivity for GPS and no directivity for Bluetooth/WLAN can be produced. Furthermore, since two non-cellular bands can be handled with one feed element, a circuit scale can be reduced.

Figure 11A:
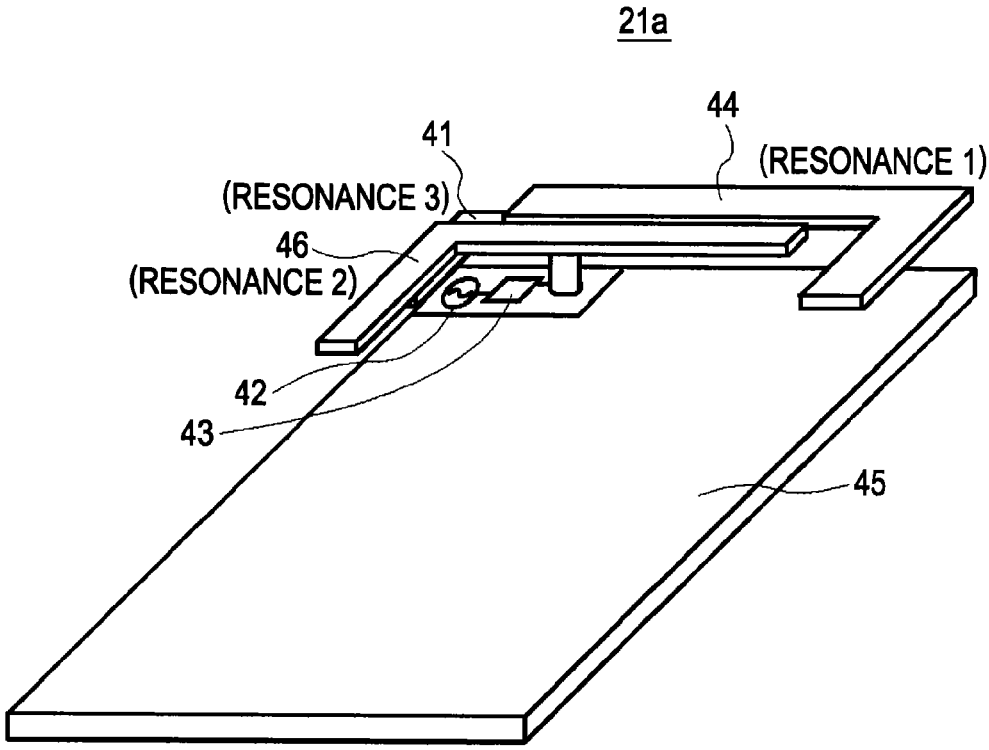
Figure 11B:
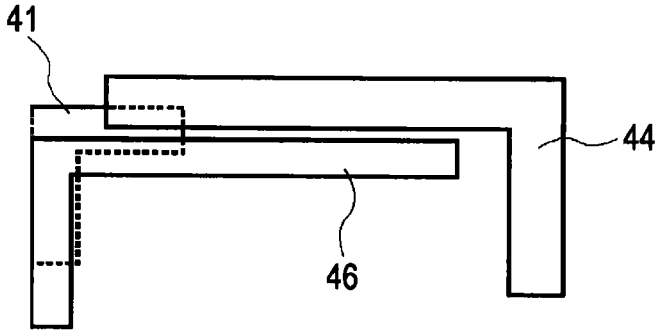
FIG. 11B is a plan view of antenna elements.

FIG. 11A illustrates an example of a configuration of an antenna device 21*a* that is a first modification of the antenna device 21 illustrated in FIG. 4. Like reference characters are attached to the same or similar components as those illustrated in FIG. 4 to avoid repeated descriptions. The antenna device 21*a* differs from the antenna device 21 in that the antenna device 21*a* includes a third antenna element 46 serving as another parasitic element. FIG. 11B illustrates a plan view of the first, second, and third antenna elements 41, 44, and 46, respectively. The third antenna element 46 has a part that faces at least a part of the first antenna element 41 substantially in parallel and forms expected capacitive coupling with the first antenna element 41.

Figure 12:
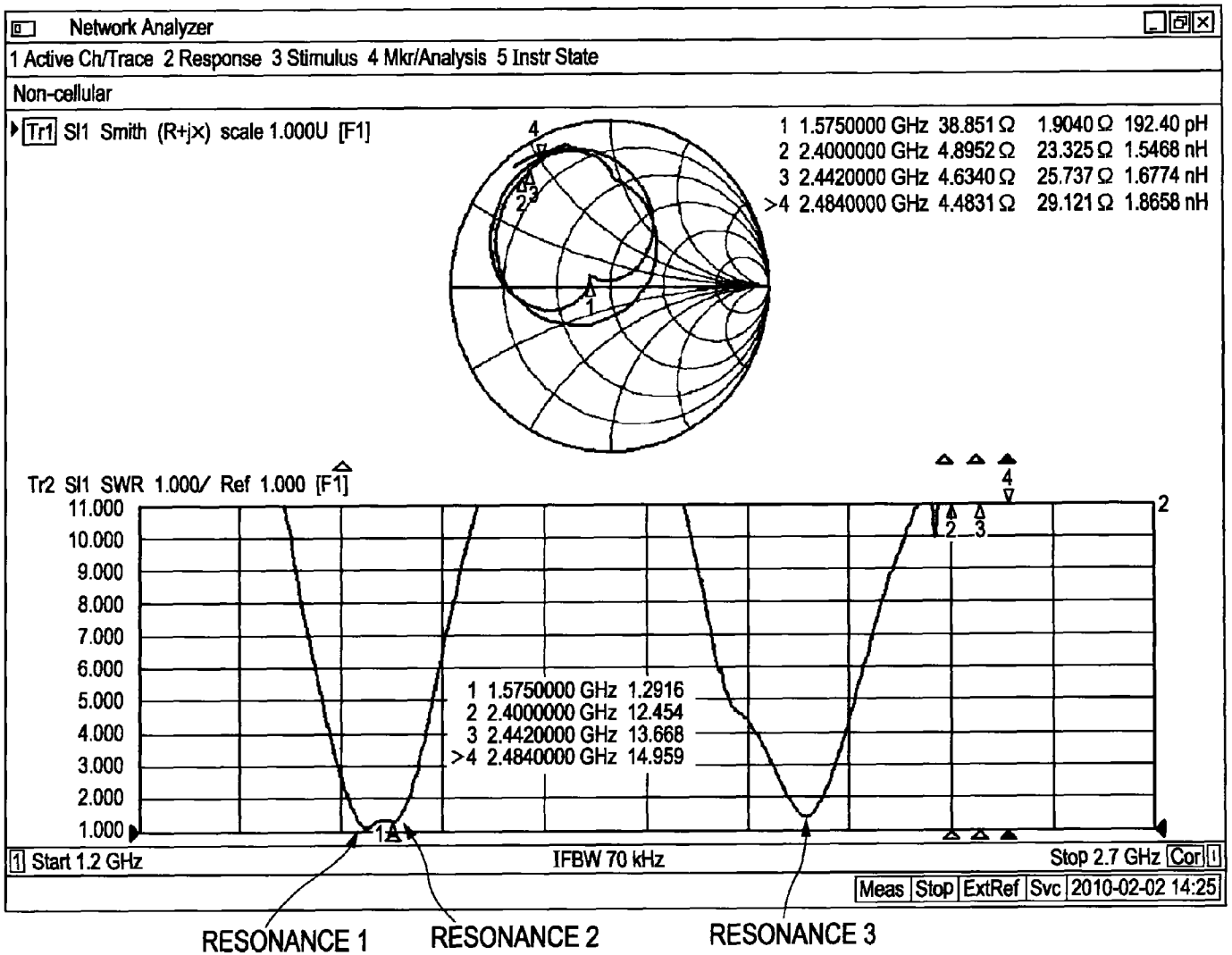
FIG. 12 is a diagram illustrating an actually measured frequency characteristic of the antenna device illustrated in FIG. 11A.

FIG. 12 illustrates an actually measured frequency characteristic of the antenna device 21*a* illustrated in FIG. 11A. This example also illustrates a change in VSWR in a frequency range of 1.2-2.7 GHz as a graph. FIG. 12 indicates that first and second resonance points have an overlapping area at around 1.575 GHz in the GPS band and a bandwidth is expanded. FIG. 12 further indicates that a third resonance point is generated at around 2.1 GHz.

Figure 13:
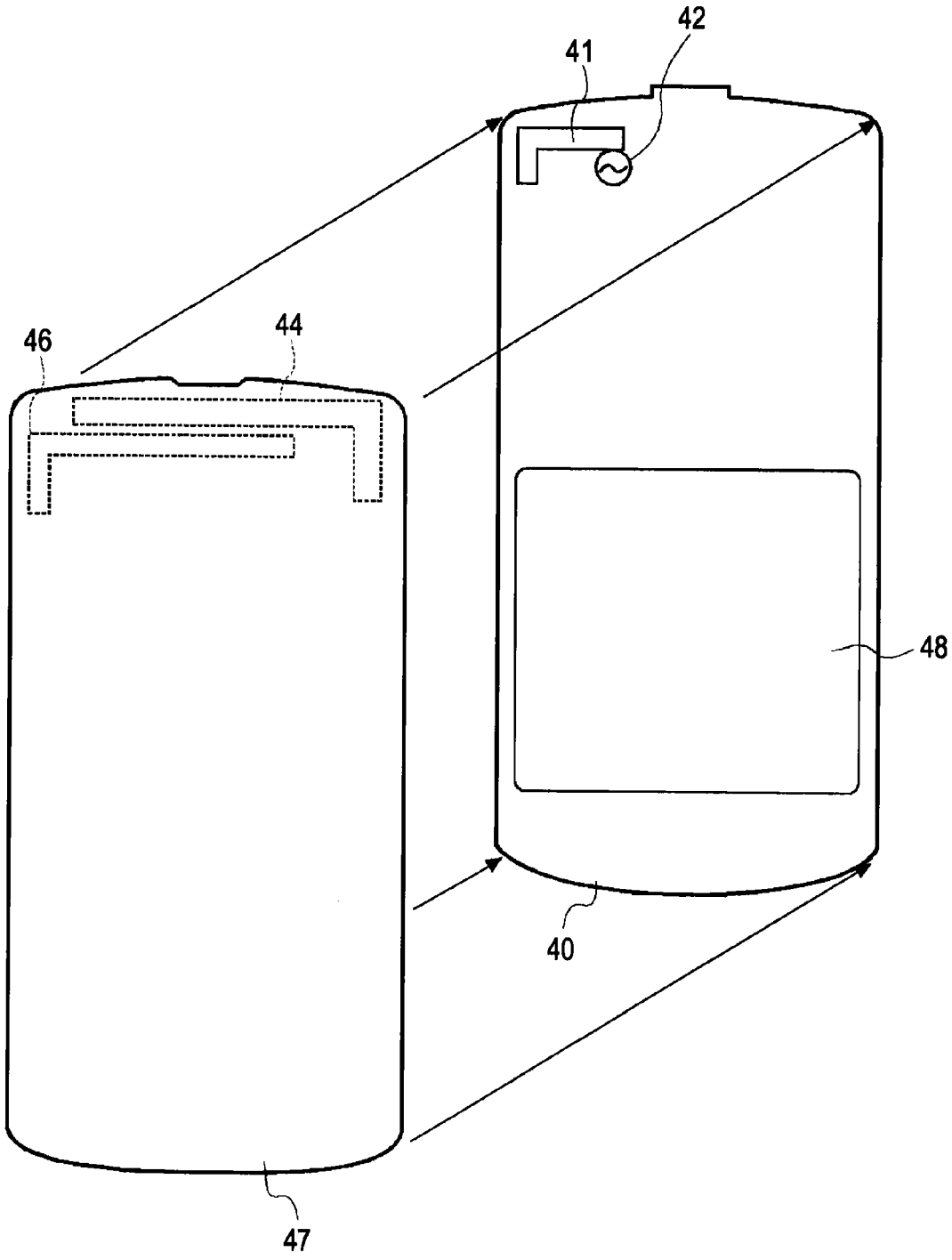
FIG. 13 is a diagram illustrating a specific application example of the antenna device illustrated in FIG. 11A to a mobile wireless terminal.

FIG. 13 illustrates a specific application example of the antenna device 21*a* illustrated in FIG. 11A to a mobile wireless terminal. Like reference characters are attached to the same or similar components as those illustrated in FIG. 11A to avoid repeated descriptions. Like the antenna device 21 illustrated in FIG. 9, the second and third antenna elements 44 and 46 of the antenna device 21*a* serving as parasitic elements are disposed on one surface (e.g., an inner surface) of the cover 47. Accordingly, the antenna device 21*a* can offer advantages similar to those offered by the second antenna element 44 described above.

Furthermore, the configuration of the antenna device 21*a* illustrated in FIG. 11A can widen a resonance frequency band of the antenna device and can cope with a plurality of bands. For example, when a service of a positioning system using a frequency different from that of the current GPS, such as global navigation satellite system (Glonass), becomes available, a dual band of the GPS and the Glonass can be handled with one antenna device.

Figure 14:
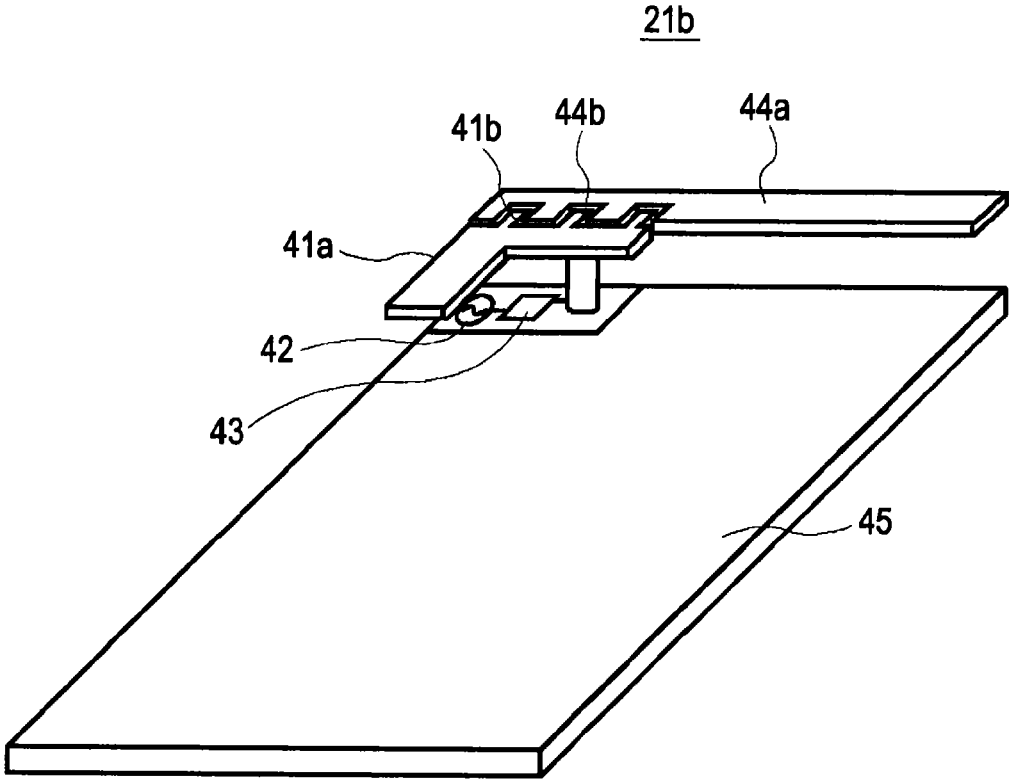
FIG. 14 is a diagram illustrating an example of a configuration of a second modification of the antenna device illustrated in FIG. 4.

FIG. 14 illustrates an example of a configuration of an antenna device 21*b* that is a second modification of the antenna device 21 illustrated in FIG. 4. Like reference characters are attached to the same or similar components as those illustrated in FIG. 4 to avoid repeated descriptions. The antenna device 21*b* differs from the antenna device 21 in that a side of a first antenna element 41*a*, i.e., a feed element of a monopole antenna disposed inside a housing, includes a comb-teeth-like portion 41*b*. Furthermore, a second antenna element 44*a* includes a comb-teeth-like portion 44*b* that faces the comb-teeth-like portion 41*b* of the first antenna element 41*a* to engage with (or be interleaved with) each other on virtually the same plane. In this state, the second antenna element 44*a* suitably capacitively couples to the first antenna element 41*a*. In this case, the first and second antenna elements 41*a* and 44*a*, respectively, can be disposed on a surface of an insulating base (not illustrated).

Although the comb-teeth-like portion 41*b* of the first antenna element 41*a* has a convex shape and the comb-teeth-like portion 44*b* of the second antenna element 44*a* has a concave shape in this example, the shapes may be opposite.

In the above-described configuration of disposing antenna elements other than the first antenna element on the cover side, the first antenna element disposed on the housing side and the second antenna element disposed on the cover side are disposed as separate members. Accordingly, a gap between the members is accompanied by an error. As a result, an error may be caused in a capacitance value derived from capacitive coupling between the first antenna element 41 and the second antenna elements 44.

However, in the second modification illustrated in FIG. 14, the more accurate capacitance value can be advantageously derived from the capacitive coupling between the first antenna element 41*a* and the second antenna element 44*a* by disposing both of the first antenna element 41*a* and the second antenna element 44*a* on a component in the housing. Additionally, regarding production of antennas, since the second modification can be applied to a type of antenna (a flexible film antenna) in which a flexible film is adhered on a cavity formed of a general plastic, the second modification is more suitable for mass production.

Reasons why the embodiments of the present invention can eliminate nulls in the upper hemisphere will now be discussed. As described above, two nulls in the upper hemisphere are considered to be problematic herein. The parasitic element is disposed at a top part of a mobile wireless terminal to eliminate these nulls. It is considered that the parasitic element serves as an excitation source of a radio wave that has an electric field component in parallel to the parasitic element, and the electric field component serves to compensate for a drop of the antenna radiation at the nulls. Possible reasons why an occurrence state of nulls differs between an antenna device according to the related art and an antenna device according to an embodiment of the present invention will be described below.

Figure 15:
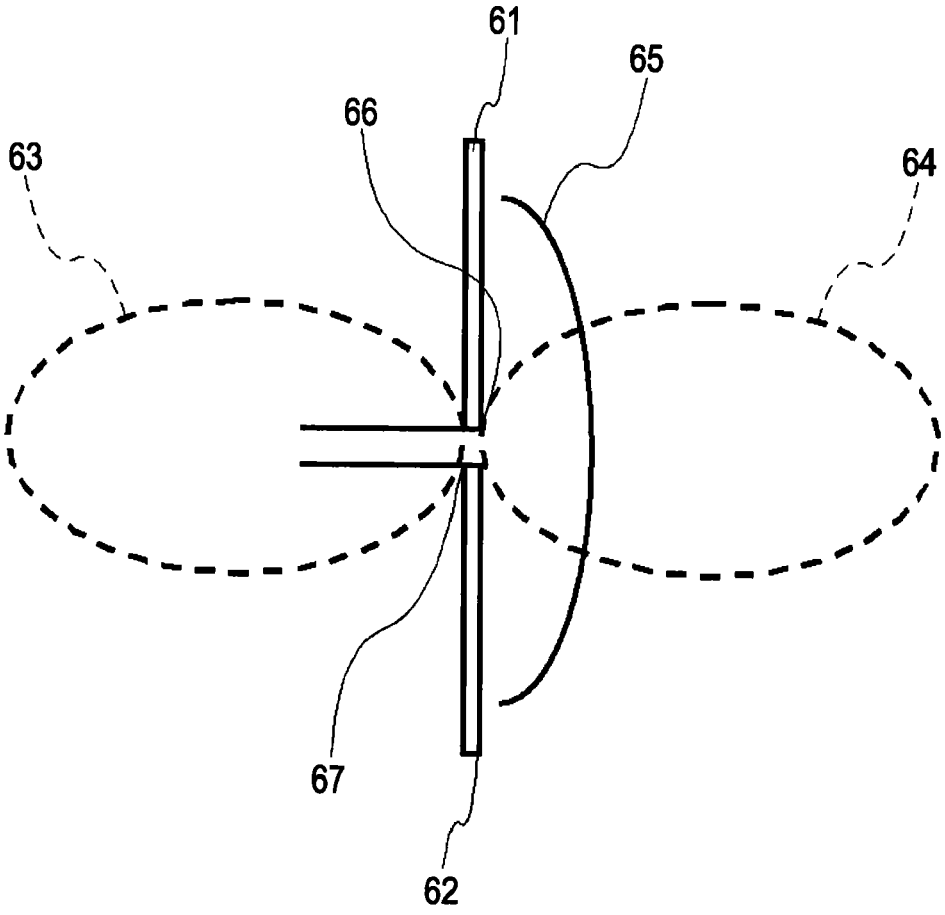
FIG. 15 is a diagram illustrating a relation between a radiation pattern of a dipole antenna and positions of nulls for basic knowledge regarding occurrence of the nulls.

FIG. 15 illustrates a relation between a radiation pattern of a dipole antenna and positions of nulls as basic knowledge regarding occurrence of the nulls. A current distribution 65 of the dipole antenna reaches the maximum at around a center of two antenna elements 61 and 62 of the dipole antenna and zero at outer ends. Radiation patterns 63 and 64 are formed in a direction vertical to the antenna elements 61 and 62. Nulls 66 and 67 are formed in an extending direction of the antenna elements 61 and 62. Generally in the monopole antenna, a ground plane (i.e., a plate) serves as one of the antenna elements of the dipole antenna.

Figure 16A:
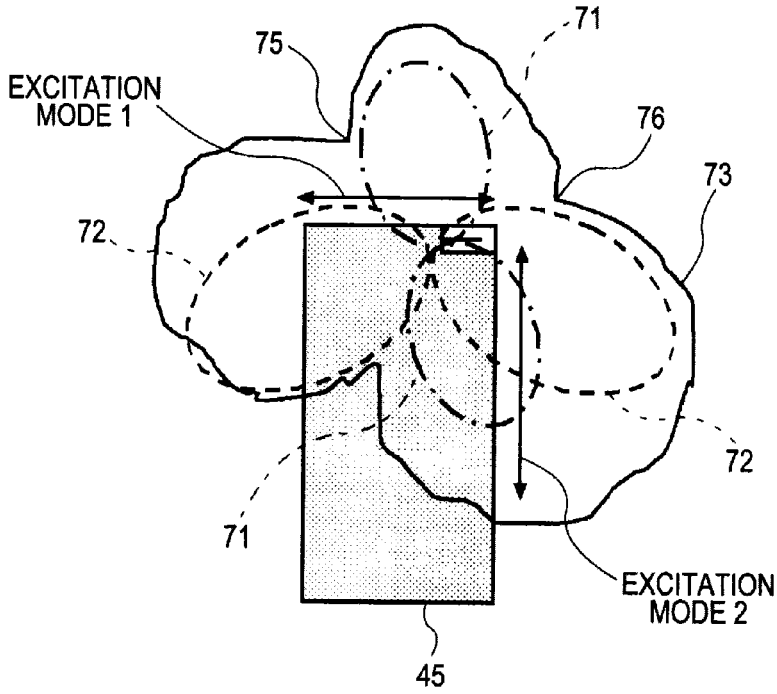
Figure 16B:
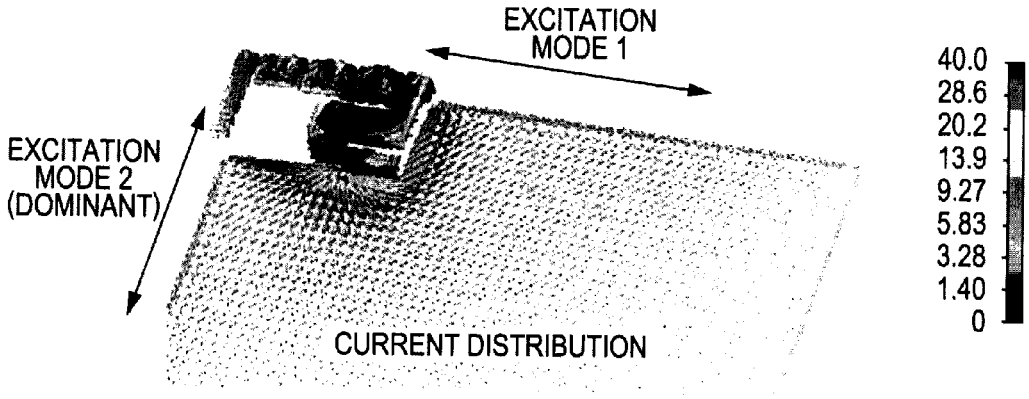
FIG. 16B is a diagram illustrating a current distribution of the monopole antenna.

A monopole antenna according to the related art has two excitation modes along two sides of the ground plane as is shown by a current distribution illustrated in FIG. 16B. If a plate 45 is long, a radiation lobe inclines in a direction of the plate 45. Accordingly, a radiation lobe 72 of an excitation mode 2 inclines in the direction of the plate 45. A radiation lobe 71 of an excitation mode 1 does not incline much. A composed radiation pattern 73 illustrated in FIG. 16A results from composition of the radiation lobe 71 of the excitation mode 1 and the radiation lobe 72 of the excitation mode 2. It is shown that the composed radiation pattern 73 includes two nulls 75 and 76 in the upper hemisphere. The radiation pattern 73 corresponds to the actually measured antenna characteristic pattern illustrated in FIGS. 2 and 3.

Figure 17A:
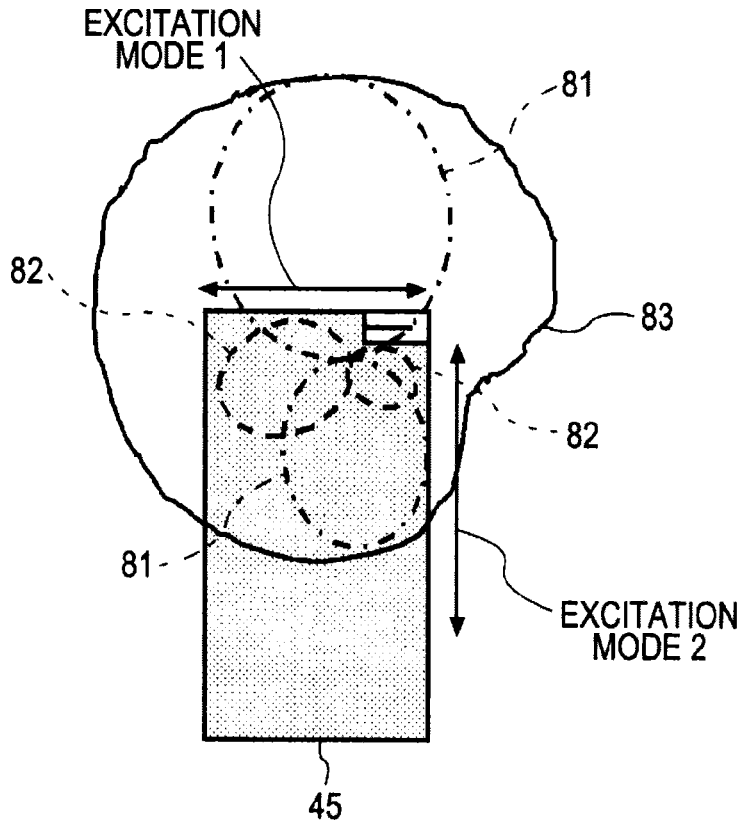
FIGS. 17A and 17B are diagrams regarding an antenna device according to an embodiment of the present invention and correspond to FIGS. 16A and 16B, respectively.
Figure 17B:
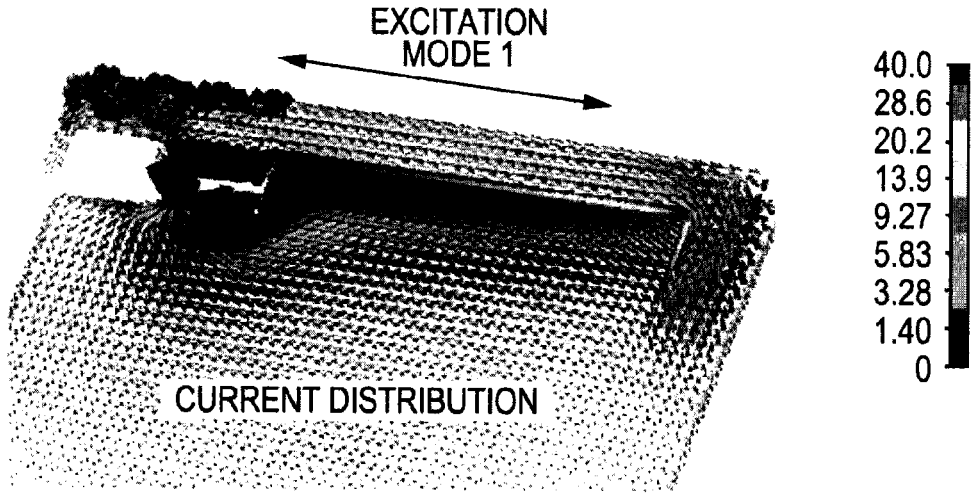

In contrast, FIGS. 17A and 17B are regarding an antenna device according to an embodiment of the present invention and correspond to FIGS. 16A and 16B, respectively. As is shown by a current distribution illustrated in FIG. 17B, the excitation mode 1 becomes dominant and the excitation mode 2 hardly has an influence thanks to addition of the second antenna element, i.e., a parasitic element, in the embodiment of the present invention. Accordingly, as illustrated in FIG. 17A, a radiation pattern 83 resulting from composition of a radiation pattern 81 of the excitation mode 1 and a radiation pattern 82 of the excitation mode 2 is obtained. The radiation pattern 83 includes no nulls in the upper hemisphere. The radiation pattern 83 corresponds to the actually measured antenna characteristic pattern illustrated in FIGS. 7 and 8.

To generate resonance of the excitation mode 1 at a desired frequency, the parasitic element is set to have an appropriate electrical length. In this case, it is important to dispose the parasitic element in parallel to an upper side of the mobile wireless terminal.

Although the embodiments of the present invention have been described above, various modification and alterations other than the above-described ones can be made without departing from the scope of the present invention. For example, the embodiments of the present invention are not limited to non-cellular antenna devices though the non-cellular antenna devices are mainly described above. For example, one of the plurality of resonance points may be utilized for a receive-only diversity sub antenna.

It should be understood by those skilled in the art that various modifications, combinations, sub-combinations and alterations may occur depending on design requirements and other factors insofar as they are within the scope of the appended claims or the equivalents thereof.

What is claimed is:

1. A mobile wireless terminal comprising:

a housing;

a cover attached to the housing; and an antenna device disposed inside the housing, the antenna device including a first antenna element that serves as a feed element, a plate positioned as a ground plane for the first antenna element, and a second antenna element disposed on one surface of the cover facing the first antenna element, and capacitively coupled to the first antenna element, the second antenna element being a parasitic element, wherein when said mobile wireless terminal is positioned for Global Positioning System (GPS) reception, an upper hemisphere antenna pattern of said antenna device is free of nulls greater than 1 dB.

2. The mobile wireless terminal of claim 1, wherein:

a length of the first antenna element being approximately one quarter wavelength of a radio frequency signal in an antenna resonance band; and a length of the second antenna element being longer than the length of the first antenna element.

3. The mobile wireless terminal of claim 1, wherein:

a length of the first antenna element being approximately one quarter wavelength of a radio frequency signal in an antenna resonance band; and a length of the second antenna element being longer than approximately three eighths of the wavelength of the radio frequency signal.

4. The mobile wireless terminal of claim 1, further comprising:

a third antenna element positioned to be capacitively coupled to the first antenna element.

5. The mobile wireless terminal of claim 4, wherein:

said third antenna element and said second antenna element are coplanar.

6. The mobile wireless terminal of claim 1, wherein:

the first antenna element having a comb--teeth-like portion; and the second antenna element including a comb--teeth-like portion, wherein said second antenna element positioned on a common plane with said first antenna portion, and having teeth that are interleaved with teeth of the first antenna element.

7. The mobile wireless terminal of claim 1, wherein:

said first antenna element and said second antenna element cooperate to resonate at Global Positioning System (GPS) frequencies and BLUETOOTH/WLAN frequencies.

8. The mobile wireless terminal of claim 1, wherein:

at least one of the first antenna element and the second antenna element have an L shape.

9. An antenna device disposed in a housing, the antenna device comprising:

a first antenna element that serves as a feed element, a plate positioned as a ground plane for the first antenna element, and a second antenna element disposed on one surface of the housing facing the first antenna element, and capacitively coupled to the first antenna element, the second antenna element being a parasitic element, wherein when a mobile wireless terminal including said antenna device is positioned for Global Positioning System (GPS) reception, an upper hemisphere antenna pattern of said antenna device is free of nulls greater than 1 dB.

10. The antenna device of claim 9, wherein:

a length of the first antenna element being approximately one quarter wavelength of a radio frequency signal in an antenna resonance band; and a length of the second antenna element being longer than the length of the first antenna element.

11. The antenna device of claim 9, wherein:

a length of the first antenna element being approximately one quarter wavelength of a radio frequency signal in an antenna resonance band; and a length of the second antenna element being longer than approximately three eighths of the wavelength of the radio frequency signal.

12. The antenna device of claim 9, further comprising:

a third antenna element positioned to be capacitively coupled to the first antenna element.

13. The antenna device of claim 12, wherein:

said third antenna element and said second antenna element are coplanar.

14. The antenna device of claim 9, wherein:

the first antenna element having a comb--teeth-like portion; and the second antenna element including a comb--teeth-like portion, wherein said second antenna element positioned on a common plane with said first antenna portion, and having teeth that are interleaved with teeth of the first antenna element.

15. The antenna device of claim 9, wherein:

said first antenna element and said second antenna element cooperate to resonate at Global Positioning System (GPS) frequencies and BLUETOOTH/WLAN frequencies.

16. The antenna device of claim 9, wherein:

at least one of the first antenna element and the second antenna element have an L shape.

* * * * *